US005549453A

United States Patent [19]

Murakami et al.

[11] Patent Number: 5,549,453

[45] Date of Patent: Aug. 27, 1996

[54] RECIPROCATING-PISTON-TYPE COMPRESSOR HAVING PISTON ENTERING DISCHARGE CHAMBER

[75] Inventors: Kazuo Murakami; Toshiro Fujii; Yuichi Kato, all of Kariya, Japan

[73] Assignee: Kabushiki Kaisha Toyoda Jidoshokki Seisakusho, Aichi, Japan

[21] Appl. No.: 455,191

[22] Filed: May 31, 1995

[30] Foreign Application Priority Data

Jun. 2, 1994 [JP] Japan ..... 6-120965

[51] Int. Cl.[6] ..... F04B 39/10

[52] U.S. Cl. ..... 417/269; 417/515; 417/570; 137/512.4

[58] Field of Search ..... 417/269, 515, 417/516, 570; 137/512.4

[56] References Cited

U.S. PATENT DOCUMENTS

| | | | |
|---|---|---|---|
| 1,210,649 | 1/1917 | Holley et al. | 417/570 |
| 1,628,944 | 5/1927 | Wright et al. | 417/570 |
| 2,457,339 | 12/1948 | Bertea | 417/570 |
| 2,672,095 | 3/1954 | Lucien et al. | 417/570 |
| 5,242,276 | 9/1993 | Shimizu | 417/269 |
| 5,370,506 | 12/1994 | Fujii et al. | 417/269 |

FOREIGN PATENT DOCUMENTS 1134085 5/1989 Japan .

*Primary Examiner*—Charles Freay
*Assistant Examiner*—Roland G. McAnderws, Jr.
*Attorney, Agent, or Firm*—Burgess, Ryan and Wayne

[57] ABSTRACT

A reciprocating piston type compressor for compressing refrigerant gas includes a cylinder block with a plurality of parallel cylinder bores arranged around the longitudinal axis of the cylinder block, the cylinder bores having bore ends as discharge ports of the same diameter as that of the cylinder bores, a plurality of pistons slidably provided within the cylinder bores for reciprocating between the top and bottom dead centers, the inner surface of the cylinder bores and the end faces of the piston defining compression chambers, housing means sealingly mounted to the either ends of the cylinder block, the housing means including at least a discharge chamber into which the compressed refrigerant gas is discharged from the compression chambers through the bore ends, a drive shaft for driving compressing motion of the reciprocating pistons within the cylinder bores, the drive shaft extending along the longitudinal axis of the compressor, and valve members for closing the bore ends of the cylinder bores, the valve members being movable in the axial direction between a closed position where the valve members close the bore ends, and an open position where the valve members are away from the bore ends.

7 Claims, 4 Drawing Sheets

RECIPROCATING-PISTON-TYPE COMPRESSOR HAVING PISTON ENTERING DISCHARGE CHAMBER

BACKGROUND OF THE INVENTION

1. Field of the Invention

The present invention relates to a reciprocation-piston-type refrigerant compressor which is improved to increase its discharge and suction efficiency.

2. Description of the Related Art

In the field of compressors, a well-known reciprocating-piston-type refrigerant compressor comprises a cylinder block including a plurality of parallel cylinder bores arranged around an axial drive shaft, and double-headed pistons slidably provided within the cylinder bores for reciprocating between the top dead center and the bottom dead center. The refrigerant gas is compressed by the reciprocating double-headed pistons. A swash plate cooperating with the pistons is mounted on the drive shaft inserted into a center bore in the cylinder block. When the drive shaft rotates, the pistons are reciprocated within the cylinder bores, by the swash plate. An example is shown is Japanese Unexamined Patent Publication (Kokai) No 1-134085.

Front and rear housings, each of which includes a suction chamber and a discharge chamber, are sealingly attached to both ends of the cylinder block. Valve assemblies with valve plates and suction and discharge valves are provided between the cylinder block and the front and rear housings. The valve plates include suction ports which provide fluid communication between the suction chamber and the cylinder bores, and discharge ports which provide fluid communication between the discharge chamber and the cylinder bores. The suction valves and the discharge valves are provided at the suction ports and the discharge ports, respectively.

The refrigerant gas is introduced from the suction chamber into the cylinder bores within which the pistons move toward the bottom dead center through the suction valves, and the refrigerant gas in the cylinder bores within which the pistons move toward the top dead center is compressed and discharged through the discharge valves into the discharge chambers. The suction valves and discharge valves are opened by the differential pressure of the refrigerant gas passing therethrough.

SUMMARY OF THE INVENTION

In such a compressor, a top clearance between the inner faces of the respective valve plates and end faces of the double-headed piston at the top dead center must be provided to compensate for the dimensional tolerance of the elements, such as the valve plates and the cylinder block, and the thermal expansion of the pistons due to the heat generated during the compression of the refrigerant gas. The top clearance allows the residual gas to remain in the space of the top clearance which reduces the discharge efficiency. The residual gas also expands again when the pistons move towards the bottom dead center, which reduces the suction efficiency.

FIG. 6 is a partial schematic illustration of an example of a prior art valve assembly showing a valve plate 60, one of discharge ports 61 and one of the discharge valves 62. According to the prior art, the discharge ports 61 in the valve plates 60 have dead spaces because the valve plate 60 has thickness. The dead space increases the residual gas therein which reduces the discharge and suction efficiency. In order to reduce the dead space, if the diameter of the discharge ports 61 is reduced, overpressure would be generated in the compressed refrigerant gas during high speed operation of the compressor due to the effect of the orifice. This results in overstress on the valve plate 60. Further, pressure waves generated by the overpressure are a source of noise which, in case of a compressor for a vehicle, harms the automobile driving environment.

The invention is directed to solve the above mentioned problems and to provide a reciprocating type refrigerant compressor with discharge ports which allow the compressor to increase its discharge and suction efficiency by reducing the residual gas in the discharge ports.

In accordance with the invention, there is provided a reciprocating-piston-type compressor for compressing refrigerant gas including a cylinder block with a plurality of parallel cylinder bores arranged around the longitudinal axis of the cylinder block, the cylinder bores having bore ends as a discharge port of the same diameter as that of the cylinder bores, a plurality of pistons slidably provided with in the cylinder bores for reciprocating between the top and bottom centers, the inner surface of the cylinder bores and the end faces of the piston defining compression chambers, refrigerant gas being introduced into the compression chambers within which the pistons move toward the bottom dead center, the refrigerant gas in the compression chambers within which the pistons move toward the top dead center being discharged therefrom after compression, housing means sealingly mounted to the either ends of the cylinder block, the housing means including at least a discharge chamber into which the compressed refrigerant gas is discharged from the compression chambers through the bore ends, a drive shaft for driving the compressing motion of the reciprocating pistons within the cylinder bores the drive shaft extending along the longitudinal axis of the compressor, and valve members for closing the bore ends of the cylinder bores, the valve members being movable in the axial direction between a closed position where the valve members close the bore ends, and an open posision where the valve members are away from the bore ends.

Refrigerant gas is introduced into the compression chambers within which the pistons move toward the bottom dead center, since the pressure in the compression chambers is reduced. The pressure in the compression chambers within which the pistons move toward the top dead center increases. When the pressure reaches at a given pressure level, the valve members are moved to the open position, and the refrigerant gas in the compression chambers is discharged therefrom without restriction.

The residual gas can be reduced by providing the bore ends as discharge ports having the same diameter as that of the cylinder bores. Therefore, the discharge and suction efficiency can be increased.

Preferably, the top dead center position of the pistons is provided in a plane perpendicular to the longitudinal axis between the bore ends of the cylinder bores and the inner faces of the valve members which is at the open position. This allows all the refrigerant gas in the compression chambers to be discharged.

The compressor may further comprise stopper means for stopping the axial movement of the valve members at the closed position and the open position. Preferably, the stopper means comprises valve seat faces on the periphery of the bore ends of the respective cylinder bores; and retainers axially extending from the inner surface of the housing means.

Alternatively, the compressor further comprises at least a rotary valve provided on the drive shaft for rotation therewith so as to distribute refrigerant gas to the compression chambers within which the piston move toward the bottom center. The rotary valve can reduce the pulsation due to the movement of the suction valve in the prior art, which allows the mechanical noise of the compressor to be reduced.

Preferably, the compressor comprises an inlet port fluidly connected to an external refrigerating circuit for receiving refrigerant gas, and the at least a rotary valve including a refrigerant gas passage continuously fluidly connected to the inlet port during a rotation of the drive shaft, and intermittently fluidly connected to the compression chambers so as to distribute refrigerant gas from the inlet port to the compression chambers within which the pistons move toward the bottom dead center.

In the preferred embodiment of the invention, the compressor may further comprise means for resiliently biasing the valve member to the closed position. The biasing means may comprise flat springs connecting the valve member to each other.

Biasing the valve members to the closed position increases the speed of the axial movement of the valve member to the closed position, which can reduce the back flow of the compressed refrigerant gas for the discharge chamber into the compression chamber.

BRIEF DESCRIPTION OF THE DRAWING

The above and other objects, features and advantages of the present invention will be made more apparent from the ensuing description with reference to the accompanying drawings wherein.

DESCRIPTION OF THE PREFERRED EMBODIMENTS

Figure 1:
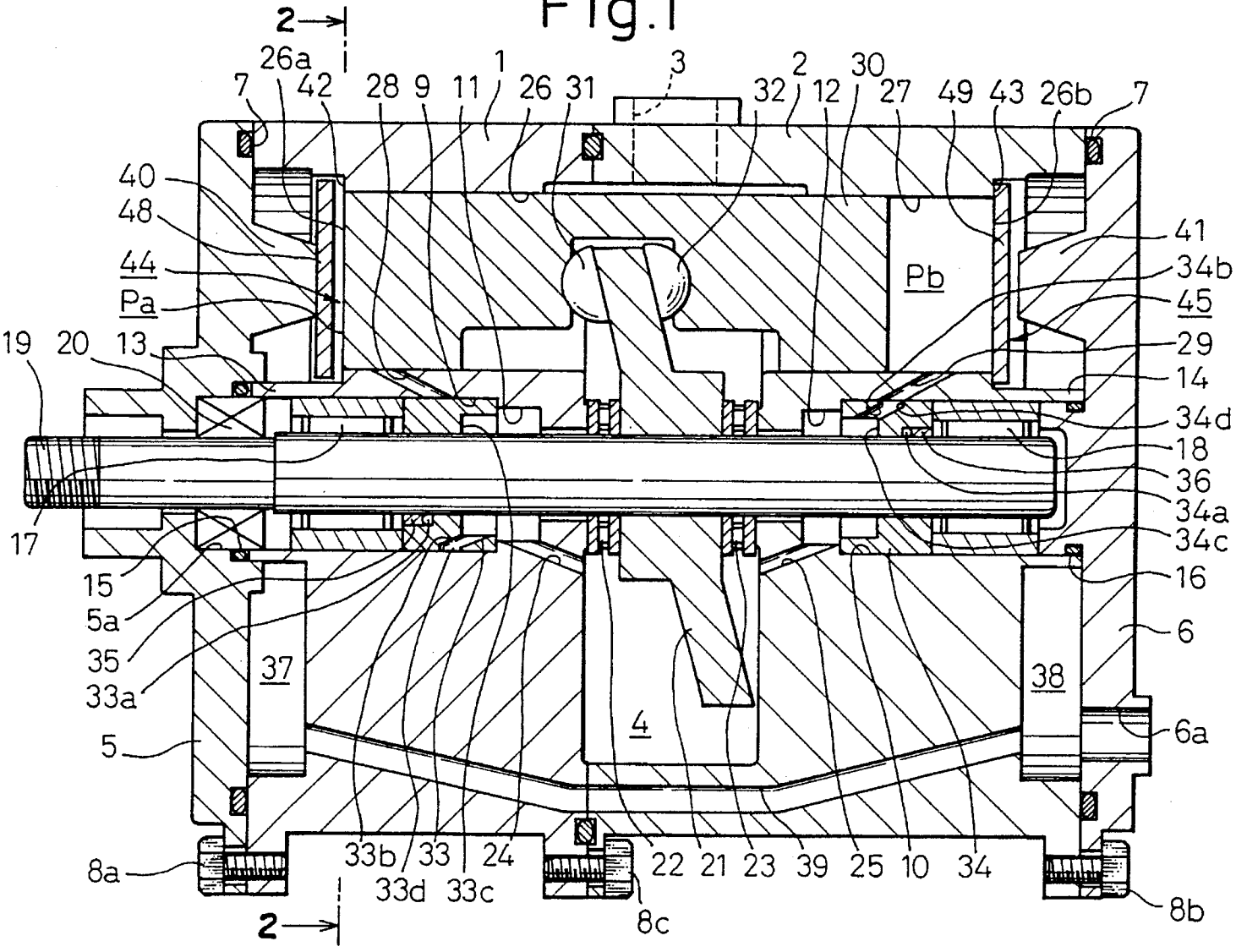
FIG. 1 is a cross sectional view of an embodiment of the invention.
Figure 2:
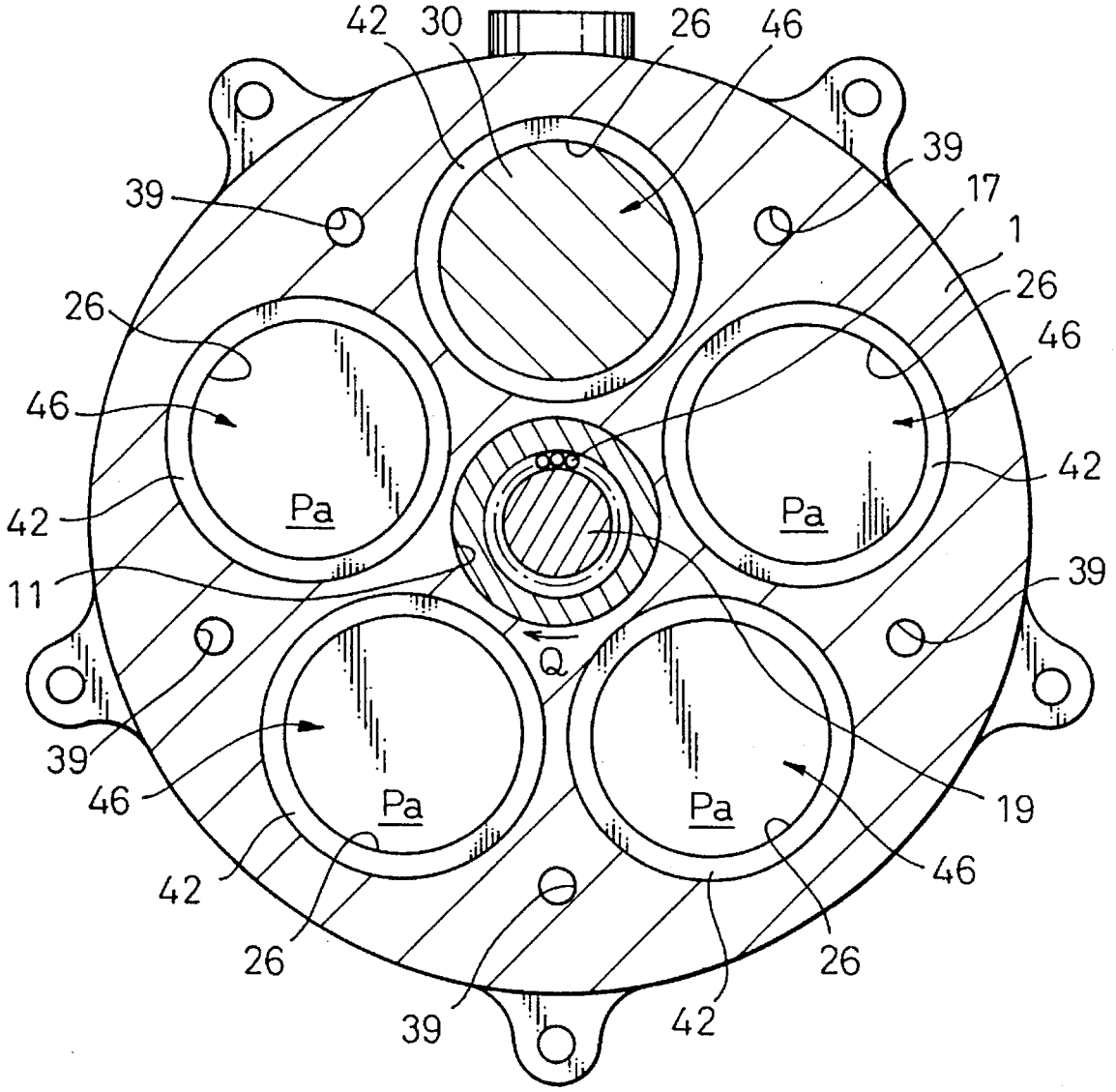
FIG. 2 is a cross sectional view of the compressor shown in FIG. 1 taken along line 2—2 in the direction shown in FIG. 1.
Figure 3:
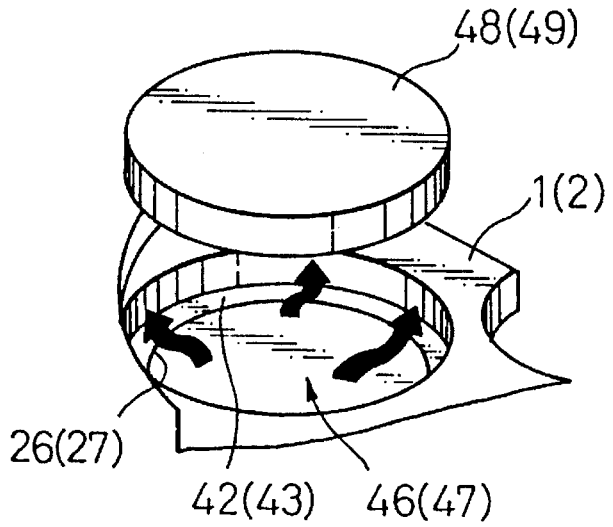
FIG. 3 is a partial enlarged view of the bore end of the compressor shown in FIG. 1.

With reference to FIGS. 1–3, the preferred embodiment of the invention will now be described.

In FIG. 1, a double-headed reciprocating piston type refrigerant compressor is provided with front and rear cylinder blocks 1 and 2 axially connected together by means of screw bolts 8*c* so as to form an integral cylinder block assembly, an axial drive shaft 19 rotatably mounted to the cylinder block assembly by a pair of radial bearings 17 and 18 held in central bores 9 and 10 formed in the cylinder block assembly, and front and rear housings 5 and 6 sealingly mounted to the respective ends of the integral cylinder block assembly by means of screw bolts 8*a* and 8*b*.

The integral cylinder block assembly includes a plurality of cylinder bores 26, in this embodiment five cylinder bores (FIG. 2), arranged in parallel around the longitudinal axis of the integral cylinder bore assembly, and a central swash plate chamber 4 in which an inclined swash plate 21 mounted on the drive shaft 19 is received so as to be rotated together with the drive shaft 19. A pair of thrust bearings 22 and 23 are arranged to cooperate with to the driving shaft 19 between the front cylinder block 1 and the swash plate 21, and the swash plate 21 and the rear cylinder block 2.

The rear cylinder block 2 includes a laterally extended inlet port 3 which provides fluid communication between the central swash plate chamber 4 and an evaporator (not shown) arranged in an external refrigerating circuit. The front and rear cylinder blocks 1 and 2 include suction passages 24 and 25 which provide fluid communication between the central swash plate chamber 4 and the central bores 9 and 10. The front and rear cylinder blocks 1 and 2 further include inlet passages 28 and 29 of the same number (five in this example) of the cylinder bores 26, which provide fluid communication between the respective cylinder bores 26 and the central bores 9 and 10.

Cylindrical protrusions 13 and 14 are outwardly extended from the outer ends of front and rear cylinder blocks 1 and 2, concentric to the central bores 9 and 10, for positioning the front and rear housings 5 and 6.

The front and rear housings 5 and 6 sealingly close the front and rear cylinder blocks 1 and 2 via O-rings 7, 15 and 16. One end of the drive shaft 19, i.e., a front end of the drive shaft 19 outwardly extends through a housing bore 5*a* included in the front housing 5, so that the compressor can be connected to a rotary drive source, such as an automobile engine (not shown) via an appropriate transmission mechanism (not shown). A seal 20 is provided in the housing bore 5*a* for preventing the refrigerant gas from leakage through the housing bore 5*a*.

Referring to FIG. 2, the cylinder bores 26 are equally spaced in the integral cylinder block assembly 1 and 2 around the axis of the drive shaft 19. In the cylinder bores 26, double-headed pistons 30 are slidably provided for reciprocating. The inner surfaces of the cylinder bores 26 and the ends of the double-headed pistons 30 define compression chambers Pa and Pb.

The swash plate 21 engages the double-headed pistons 30 through shoes 31 and 32 socketed in the respective pistons 30. Namely, the rotation of the drive shaft 19 and the swash plate 21 causes reciprocation of the double-headed pistons 30 in the cylinder bores 26.

Rotary valves 33 and 34 in the form of substantially cylindrical members are mounted on the drive shaft 19 for rotation with the drive shaft 19 via keys 35 and 36 on the drive shaft 19 which keys engage key groves 33*a* and 34*a* in the rotary valves 33 and 34. The rotary valves 33 and 34 are also accommodated within the central bores 9 and 10 with the outer circumferential surfaces thereof sealingly contacting inner surfaces of the central bores 9 and 10.

The rotary valves 33 and 34 include intermediate passages 33*b* and 34*b*, circumferential grooves 33*d* and 34*d*, and central recesses 33*c* and 34*c* on the inner ends of the rotary valves 33 and 34. The circumferential grooves 33*d* and 34*d* extend through a given angle with respect to the central axis of the rotary valves 33 and 34. The circumferential grooves 33*d* and 34*d* are further disposed on the circumferential surface of the drive shaft 19 so that they can communicate with the inlet passages 28 and 29 during a rotation of the drive shaft 19. The intermediate passages 33*b* and 34*b* extend between the circumferential grooves 33*d* and 34*d* and the central recesses 33*c* and 34*c*.

It should be noted that the rotary valves 33 and 34 can be made in the form of a tapered member.

The compressor further includes front and rear discharge chambers 37 and 38 each in the form of a ring or a circle between the ends of the integral cylinder block assembly and the front and rear housings 5 and 6. The rear housing 6 includes and outlet port 6*a* for fluidly connecting the rear discharge chamber 38 to a refrigerant condenser (not shown) in the external refrigerating circuit (not shown). The front and rear discharge chambers 37 and 38 are fluidly connected to each other by a discharge passage 39 in the integral cylinder block assembly.

The integral cylinder block assembly includes valve chambers 44 and 45 at the ends of the respective cylinder bores 26. The valve chambers 44 and 45 are made in the form of cylindrical bores concentric to the respective cylinder bores 26. The valve chambers 44 and 45 have a diameter greater than that of the cylinder bores 26 so that valve seat faces 42 and 43 are provided at the inner ends of the valve chambers 44 and 45. The valve chambers 44 and 45 open to the cylinder bores 26 and the front and rear discharge chambers 37 and 38.

In the valve chambers 44 and 45, valve members 48 and 49 in the form of a disc are provided so that they can move in the axial direction between a closed position where the valve members 44 and 45 contact the valve seat faces 42 and 43 to close the bore ends of the cylinder bores 26, and an open position where the valve members 44 and 45 are axially away from the valve seat faces 42 and 43 by a given distance. When the valve members 48 and 49 contact the valve seat faces 42 and 43, the fluid communication between the valve chambers 44 and 45 and the compression chambers Pa and Pb is blocked.

The front and rear housings 5 and 6 include retainers 40 and 41 as stopper means for stopping the valve members 48 and 49 at the open position. The retainers 40 and 41 are in the form of a conical protrusion extending from the inner face of the front and rear housing 5 and 6 into the respective valve chambers 44 and 45.

In an alternative embodiment, gaskets can be provided between the integral cylinder block assembly and the front and rear housings 5 and 6. In this case, the retainers 40 and 41 can be made on the inner surfaces of the gaskets.

It should be noted that the rotary valves 33 and 34 are positioned on the drive shaft 19 such that, during a rotation of the drive shaft, the circumferential grooves 33*d* or 34*d* are fluidly connected to the inlet passages 28 or 29 which communicate with the compression chambers Pa or Pb within which the double-headed pistons 30 move toward the bottom dead center, and the circumferential grooves 34*d* and 33*d* are fluidly blocked from the inlet passages 29 or 28 which communicate to the compression chambers Pb or Pa within which the double-headed pistons 30 move toward the top dead center.

The operation of the reciprocating type refrigerant compressor will be described.

When the drive shaft 19 rotates as indicated by an arrow Q in FIG. 2, the double-headed pistons 30 reciprocate within the respective cylinder bores 26. The pressure in the compression chambers Pa and Pb within which the piston 30 move toward the bottom dead end is reduced, whereby the corresponding valve members 48 or 49 move to and abut the valve seat face 42 or 43, and refrigerant gas is introduced into the corresponding compression chambers Pa or Pb through the inlet port 3, the central swash plate chamber 4, suction passages 24 or 25, the central bores 9 or 10, the intermediate passages 33*b* or 34*b*, the circumferential grooves 33*d* or 34*d*, and the inlet passages 28 or 29.

On the other hand, when the double-headed pistons 30 move toward the top dead center, i.e., the bore ends 26*a* or 26*b* within the compression chambers Pa or Pb, the circumferential grooves 34*d* or 33*d* are fluidly blocked from the inlet passages 29 or 28 which communicate with the corresponding compression chambers Pb or Pa. Then, the refrigerant gas in the corresponding compression chambers Pa or Pb is compressed, and moves the corresponding valve member 44 or 45 to the retainers 40 or 41. Thus, the compressed refrigerant gas is discharged from the corresponding compression chambers Pa or Pb through valve chambers 44 or 45, discharge chambers 37 and 38, and outlet port 6*a*.

The ends of the double-headed piston 30 can move up to the ends of the cylinder bores 26 without abutting the inner face of the valve members 44 and 45, since the compressed refrigerant gas moves the valve member 44 and 45 to the retainers 40 or 41. The movement of the valve members 44 and 45 is very quick since the force on the valve members 44 and 45 is relatively large, which is defined by the pressure in the compression chamber times the inner surface area of the valve member 44 and 45. Thus, it is not necessary to provide top clearance at the either ends of the cylinder bores 26, which allows the compressor to discharge all the compressed refrigerant gas from the compression chambers Pa and Pb.

In the prior art, a double-headed piston must be machined at high accuracy to reduce the top clearance as much as possible. However, according to this embodiment, the machining accuracy of the double-headed piston can be reduced since it is not necessary to provide top clearance at the either ends of the cylinder bores 26, which allows the cost of manufacture to be reduced.

Referring to FIG. 3, when the valve members 48 and 49 move to the retainers 40 and 41, the compressed refrigerant gas is radially discharged from the cylinder bores 26 as shown by the arrows, thus the compressed gas can flow without restriction.

Generally the refrigerant gas contains lubricating fluid. The surface tension of the lubricating fluid, in the prior art compressor, reduces the speed of the valve opening movement. In the described embodiment, valve members 44 and 45 have relatively large pressure receiving surfaces, and this reduces the effect of the surface tension of the lubricating fluid, and the speed of the valve opening movement can be improved. Therefore, refrigerant gas in the compression chambers Pa and Pb is not over compressed at the high operating speed, whereby the pulsation due to the over compression, which is a source of noise, can be reduced.

The reciprocating type refrigerant compressor according to the aforementioned embodiment has cylinder bores 26 with the bore ends providing discharge ports which are closed by valve members 48 and 49, which allows the valve plates of the prior art, between the integral cylinder block assembly and the front and rear housings, to be eliminated. Thus, according to the embodiment of the invention, it is possible to reduce the size of the reciprocating type refrigerant compressor and the cost of manufacture thereof.

In this embodiment, the valve members 48 and 49 are made in the form of a disc which move in the axial direction due to the differential pressure across the valve members. However, the valve member can be also reed valves in the form of a flat spring.

Figure 4:
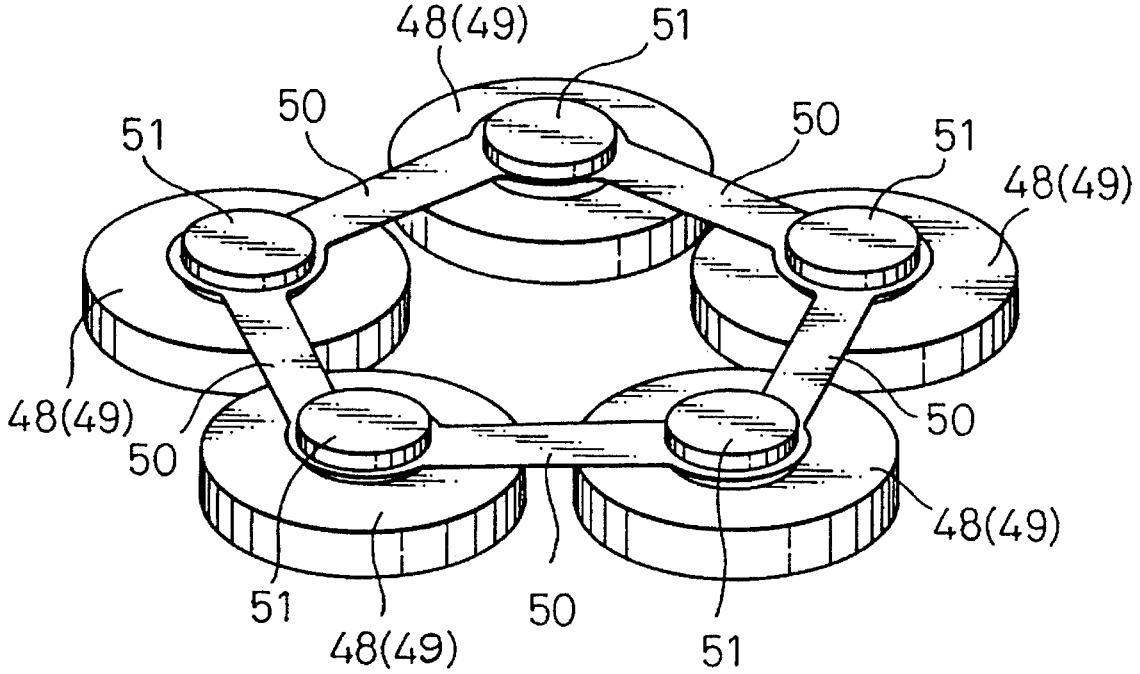
FIG. 4 is another embodiment of the valve assembly of the invention.
Figure 5:
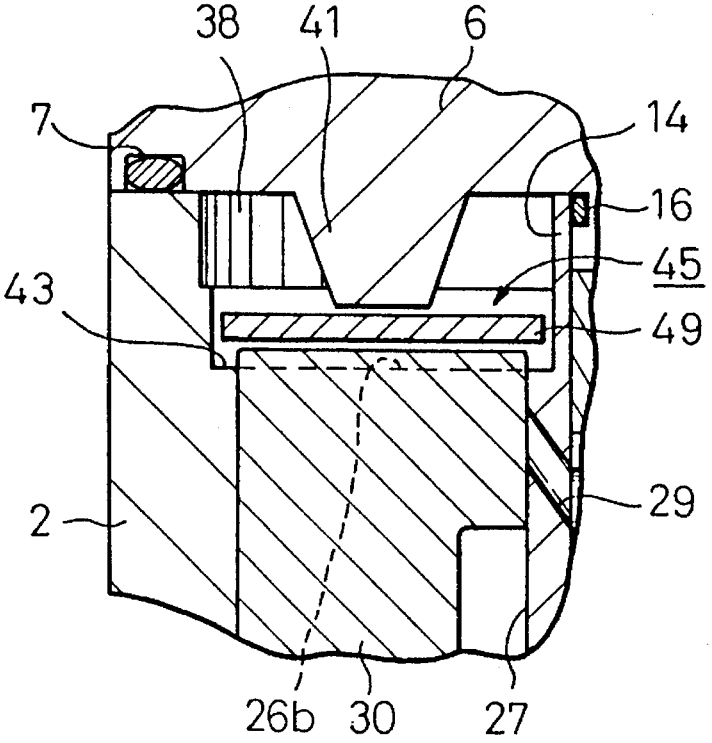
FIG. 5 is a partial enlarged section of the bore end for illustrating the position of the top dead center according to the invention.
Figure 6:
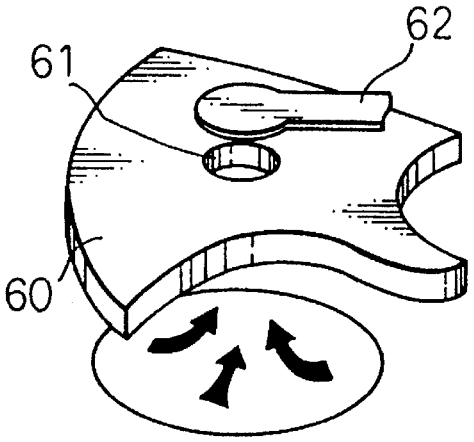
Fig.6 Prior Art
FIG. 6 is a partial schematic illustration of an example of a prior art valve assembly.

Further, in an alternative embodiment, the valve members 48 and 49 can be biased to the valve seat faces 42 and 43 by flat springs as shown in FIG. 4. In FIG. 4, the valve members 48 and 49 have central islands 51 projecting outwardly from the outer end faces thereof. The central islands 51 are connected by flat springs 50. Thus, the valve members 48 and 49 for the compression chambers Pa and Pb in discharge stroke are resiliently biased to the corresponding valve seat faces 42 and 43 since the other valve members 48 and 49 for the compression chambers in the suction stroke are pressed onto the corresponding vlave seat faces 42 and 43, which improve the response of closing movement of the valve members 48 and 49, whereby the back flow of the discharged gas from the discharge chambers 37 and 38 into the compression chambers Pa and Pb is reduced at the transition from the discharge stroke to the suction stroke.

Although, the flat springs 50 and valve members 48 and 49 are shown as separated elements in FIG. 4, they can be formed as one piece by molded resin. In this case, the hammering noise generated by abutment between the valve members 48 and 49 and the valve seat faces 42 and 43 is reduced.

Although the preferred embodiments of the invention are described, it will be understood by those skilled in the art of that invention is not limited to the aforementioned embodiments and can be improved and varied within the scope and the spirit of the invention.

For example, in the above embodiments, the front and rear cylinder blocks 1 and 2 include valve chambers 44 and 45, however, instead of this constitution, plate members, which include a plurality of bores equally disposed around the axis of the drive shaft 19 as the valve chambers 44 and 45, can be provided.

In the aforementioned embodiments, the double-headed pistons 30 reciprocate between the either ends 26*a* and 26*b* of the cylinder bores 26, however, they can move beyond the ends into the valve chambers 44 and 45 to reduce the residual refrigerant gas within the valve chambers. That is, the top dead center can be set between the bore ends 26*a* and 26*b*, and the inner surfaces of the valve members 48 and 49 abutting the retainers 40 and 41.

In the aforementioned embodiments, refrigerant gas is supplied to the compression chambers Pa and Pb through the central swash plate chamber 4, however, refrigerant gas can be supplied to the compression chambers Pa and Pb through a separate suction chamber (not shown) instead of the central swash plate chamber 4.

In the above-mentioned embodiments, the invention is realized in a swash plate type compressor with double-headed pistons, however, the invention can be applied to a swash plate type compressor with single-headed pistons, to a swash plate type variable displacement compressor, and to a wave plate type compressor disclosed in Japanese Unexamined Patent Publication No. 5-026158.

In the wave plate type compressor, the pistons can reciprocate within the cylinder bores several times for a rotation of the drive shaft. Therefore, the number of the cylinder bored of the wave plate type compressor can be reduced compared to those of the swash plate type compressor having the same displacement as well as the stroke the cylinder bores of the wave plate type compressor can be relatively short. The reduced number of the cylinder bores can increase the diameter thereof. In the prior art, the increased diameter of the cylinder bores increases the stress on the valve plate. The present invention can solve this problem.

What is claimed is:

1. A reciprocating piston compressor for compressing refrigerant gas including:

a cylinder block with a plurality of parallel cylinder bores arranged around the longitudinal axis of the cylinder block, the cylinder bores having bore ends comprising discharge ports of the same diameter as that of the cylinder bores;

a plurality of pistons slidably provided within the cylinder bores for reciprocation between top and bottom dead centers, the inner surface of the cylinder bores and the end faces of the pistons defining compression chambers, refrigerant gas being introduced into the compression chambers while the pistons move toward the bottom dead center, the refrigerant gas in the compression chambers within which the pistons move toward the top dead center being discharged therefrom after compression;

housing means sealingly mounted to the ends of the cylinder block, the housing means including at least a discharge chamber into which the compressed refrigerant gas is discharged from the compression chambers through the bore ends;

a drive shaft for driving the compressing motion of the reciprocating pistons within the cylinder bores, the drive shaft extending along the longitudinal axis of the compressor; and valve members for closing the bore ends of the cylinder bores, the valve members being movable in the axial direction between a closed position where the valve members close the bore ends, and an open position where the valve members are away from the bore ends wherein the top dead center of the pistons is in a plane perpendicular to the longitudinal axis, said plane being located between the ends of the cylinder bores and inner faces of the valve members in the open position.

2. The reciprocating piston compressor, according to claim 1, further comprising stopper means for stopping the axial movement of the valve members at the closed position and the open position.

3. The reciprocating piston compressor according to claim 2 in which the stopper means comprises valve seat faces provided on the bore ends of the respective cylinder bores, and retainers axially extending from the inner surface of the housing means.

4. The reciprocation piston type compressor according to claim 2 further comprising at least one rotary valve provided on the drive shaft for rotation therewith so as to distribute refrigerant gas to the compression chambers within which the pistons are moved toward the bottom dead center.

5. A reciprocating piston type compressor according to claim 4 further comprising an inlet port fluidly connected to an external refrigerating circuit for receiving refrigerant gas; and the at least one rotary valve including a refrigerant gas passage continuously fluidly connected to the inlet port during a rotation of the drive shaft, and intermittently fluidly connected to the compression chambers so as to distribute refrigerant gas from the inlet port to the compression chambers within which the pistons are moving toward the bottom dead center.

6. The reciprocating piston compressor according to claim 4 further comprising means for resiliently biasing the valve member to the closed position.

7. The reciprocating piston compressor according to claim 6 in which the biasing means comprises a flat spring means connecting the valve members to each other.

* * * * *